United States Patent [19]

Kraft

[11] Patent Number: 4,470,497

[45] Date of Patent: Sep. 11, 1984

[54] ESCALATOR

[75] Inventor: Joseph K. Kraft, Parsippany, N.J.

[73] Assignee: Westinghouse Electric Corp., Pittsburgh, Pa.

[21] Appl. No.: 352,678

[22] Filed: Feb. 26, 1982

[51] Int. Cl.[3] ..... B65B 9/12

[52] U.S. Cl. ..... 198/333

[58] Field of Search ..... 198/333, 326, 335, 822; 104/25

[56] References Cited

U.S. PATENT DOCUMENTS

| | | | |
|---|---|---|---|
| 2,005,067 | 6/1935 | Graff-Baker | 198/333 |
| 3,144,118 | 8/1964 | Fabula | 198/326 |
| 3,986,595 | 10/1976 | Asano et al. | 198/333 |
| 4,397,383 | 8/1983 | James | 198/333 |

FOREIGN PATENT DOCUMENTS

| | | | |
|---|---|---|---|
| 2346266 | 3/1975 | Fed. Rep. of Germany | 198/333 |
| 18685 | 2/1977 | Japan | 198/333 |
| 354169 | 9/1931 | United Kingdom | 198/326 |
| 1276922 | 6/1972 | United Kingdom | 198/333 |

*Primary Examiner*—Joseph E. Valenza
*Assistant Examiner*—Daniel R. Alexander
*Attorney, Agent, or Firm*—D. R. Lackey

[57] ABSTRACT

A moving stairway in which articulation of the steps from platform to step mode automatically positions panel members to cover the adjacent stationary skirt boards, between the tread part of each step and the riser part of the next adjacent step, and return to platform mode automatically retracts the panel members for passage through the combplate. In a preferred embodiment, the panel members additionally function as active guide elements for laterally guiding the steps through the load bearing run of the moving stairway.

22 Claims, 14 Drawing Figures

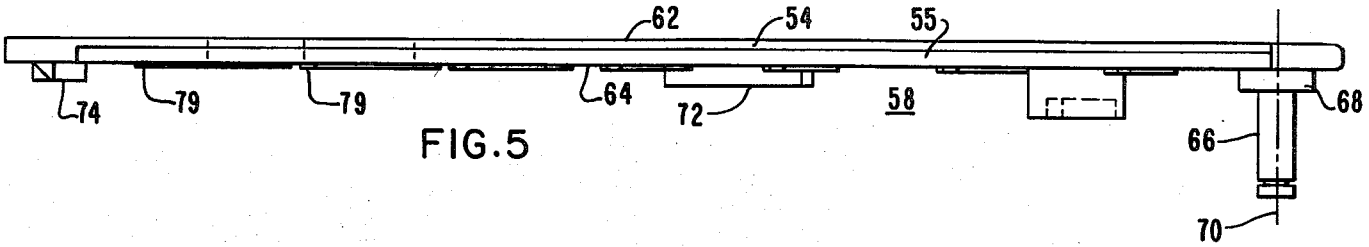
FIG. 5
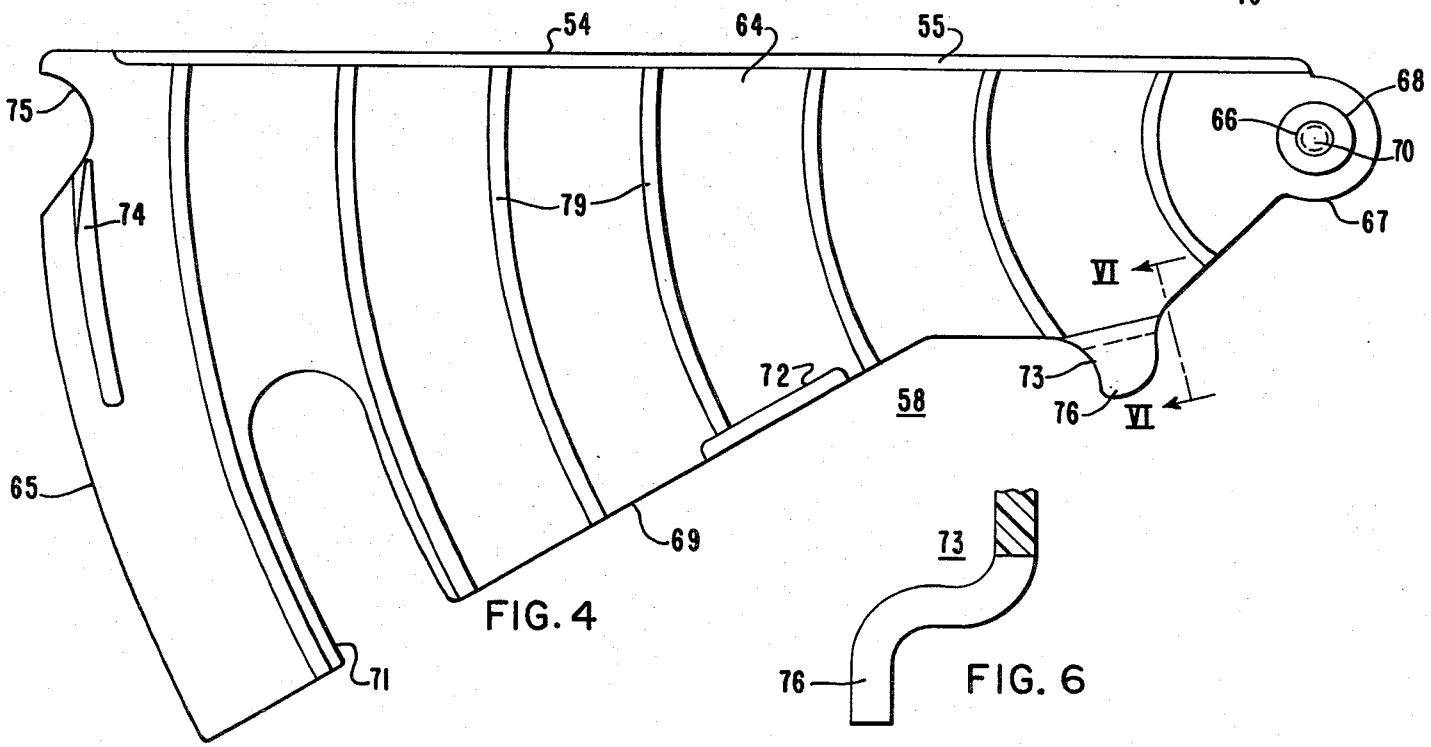
FIG. 4
FIG. 6

ESCALATOR

BACKGROUND OF THE INVENTION

1. Field of the Invention

The invention relates in general to transportation apparatus, and more specifically to moving stairways or escalators, for transporting people between spaced landings.

2. Description of the Prior Art

U.S. Pat. No. 2,981,397, discloses several embodiments of escalators directed to reducing the possibility of objects entering and being caught between relatively movable portions of the escalator. For example, as disclosed in this patent, the outer cleats of the step tread part may be constructed of a resilient material which has a lower coefficient of friction than the remaining cleats.

U.S. Pat. No. 3,986,595, discloses disposing a sensor element such that contact therewith actuates a displacement element to narrow the running gap or clearance between the step of an escalator and the adjacent skirt board.

U.S. Pat. No. 4,004,676, which is assigned to the same assignee as the present application, discloses constructing the steps of an escalator such that they have projecting portions which define fillets between the riser part and the adjacent skirt boards.

U.S. Pat. No. 4,236,623, discloses placing plastic strips along each lateral edge of the tread part. The strips include a plurality of ribs which extend into the grooves of the tread part. The strips are shaped to form a ramp-like face which angles upwardly from the horizontal surface of the tread part.

SUMMARY OF THE INVENTION

Briefly, the present invention is a new and improved escalator constructed to reduce the possibility of soft, flexible articles wedging between the moving steps and the stationary skirt boards. The invention accomplishes this by covering the skirt boards adjacent to the tread and riser parts of each step by panel means attached to the sides of each step. The panel means defines side wall portions at the lateral edges of each step. The wall portions eliminate relative motion between the tread and riser parts of the moving steps and the stationary skirt boards, and it transfers it to the upper edge of the panel means. The upper edge of the panel means is oriented parallel with the direction of step movement. Thus, the relative motion at the interface between the moving and stationary elements of the escalator has no force component tending to wedge articles under the panel means.

The panel means of each step meshes or nests with the panel means of an adjacent step such that articulation of the steps from platform to step mode automatically causes the panel means to rise to its operative position on the inclined portion of the load bearing run, and the return of the steps to platform mode automatically retracts the panel means for movement through a combplate.

In a preferred embodiment of the invention, the panel means is formed of a plastic material having a low coefficient of friction, and the skirt boards have a plastic, low friction guide surface. The skirt boards are adjusted just to the point of initial contact between the panel means and the low friction guide surface. This arrangement provides lateral guiding of the steps through the load bearing run, eliminating the need for auxiliary guiding arrangements. This arrangement also reduces the running clearance between the panel means and the adjacent skirt boards or panels to an absolute minimum.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 4 is a side elevational view of a primary plate member for one side of an escalator step, constructed according to an exemplary embodiment of the invention;

FIG. 5 is a plan view of the primary plate or panel member shown in FIG. 4;

FIG. 6 is an enlarged sectional view of a portion of the primary panel member shown in FIG. 4, taken between and in the direction of arrows VI—VI;

DESCRIPTION OF THE PREFERRED EMBODIMENTS

Figure 1:
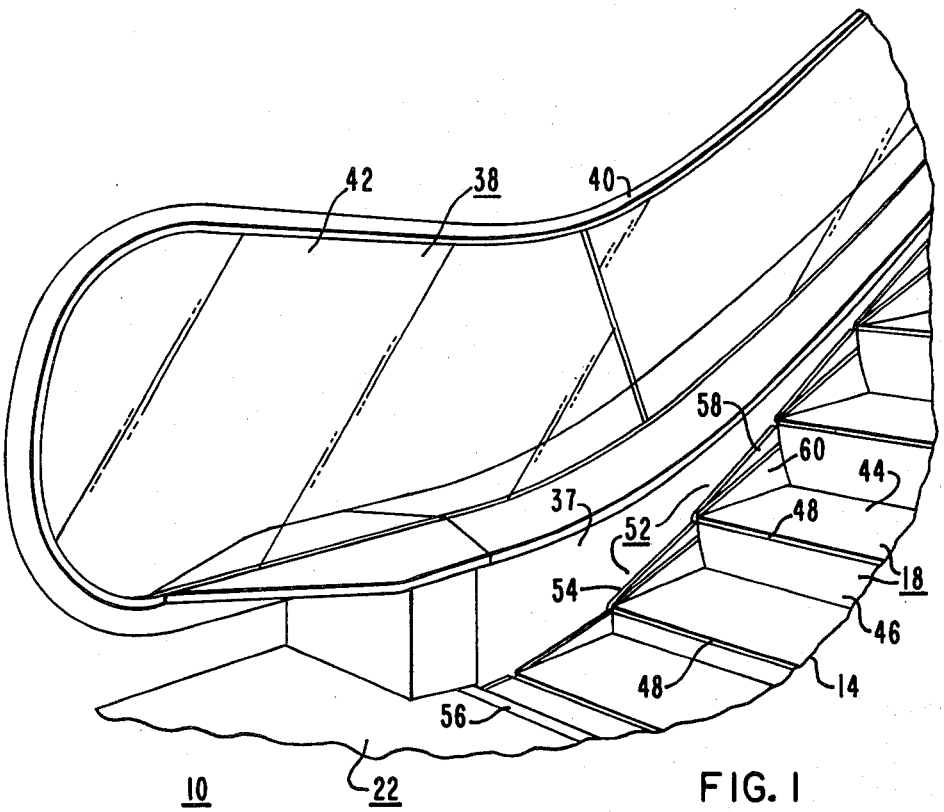
FIG. 1 is a fragmentary, perspective view of an escalator which illustrates the invention.
Figure 2A:
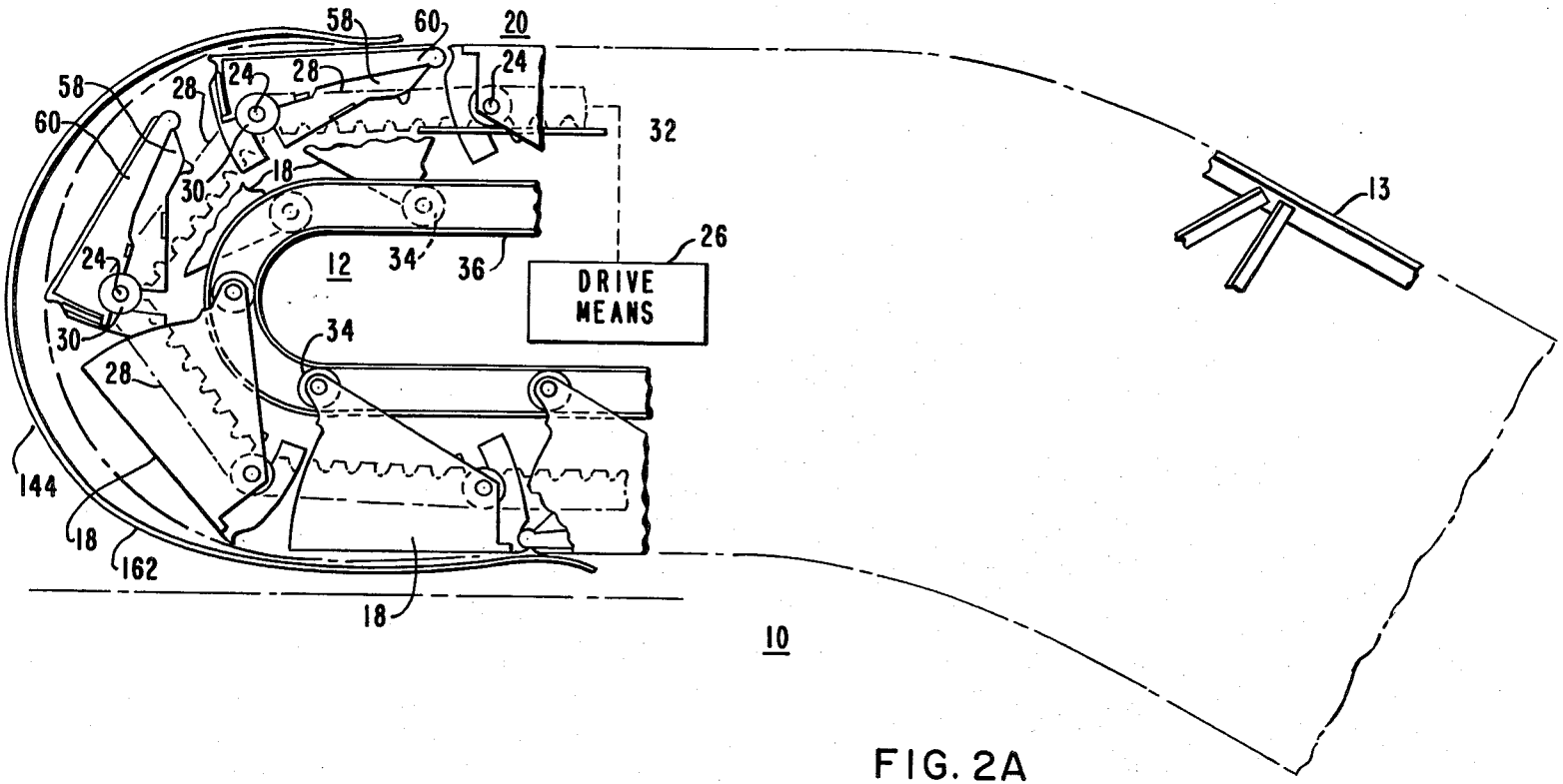
FIGS. 2A and 2B may be assembled to illustrate a side elevational view of an escalator setting forth an exemplary arrangement for insuring proper meshing of adjacent panel members following each turn-around.
Figure 2B:
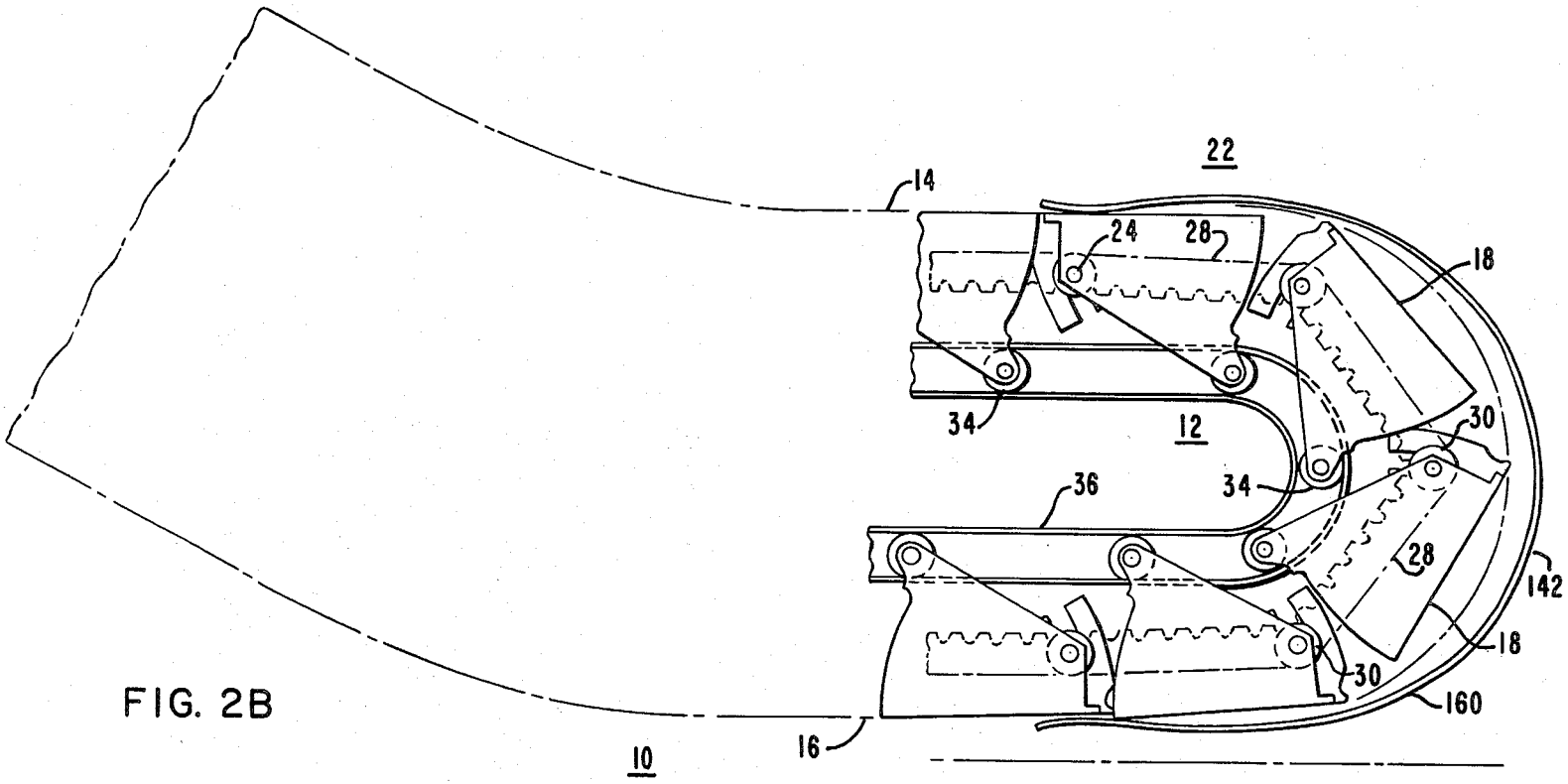

Referring now to the drawings, and to FIGS. 1,2A and 2B in particular, there is shown a moving stairway or escalator 10 which is constructed according to the teachings of the invention. FIG. 1 is a fragmentary, perspective view of the escalator 10 adjacent to the lower landing, and FIGS. 2A and 2B may be assembled to set forth a side elevational view of escalator 10 with parts broken away or not shown, in order to highlight certain aspects of the invention. Escalator 10 includes an endless, flexible conveyor unit 12, which is supported by a truss 13. Conveyor unit 12 is driven in a loop which includes an upper load bearing run 14 and a lower return run 16. A plurality of steps 18 are mounted on the conveyor unit 12 for articulation between a step mode on the inclined portion of the load bearing run 14, and platform modes in horizontal portions of the load bearing run 14, adjacent to the upper and lower landings 20 and 22, respectively.

The steps 18 are each clamped to a step axle 24, such as via the clamping arrangement shown in U.S. Pat. No. 3,789,972, which is assigned to the same assignee as the present application. The step axles 24 are part of the conveyor unit 12. The conveyor unit 12 is driven about the endless loop by drive means 26. The conveyor unit 12 may be driven in a conventional manner, such as illustrated in U.S. Pat. No. 3,414,109; or, it may be driven by the modular drive arrangement disclosed in U.S. Pat. No. 3,677,388, both of which are assigned to the same assignee as the present application.

As disclosed in U.S. Pat. No. 3,677,388, the conveyor unit 12 may include a pair of horizontally spaced endless belts constructed of toothed links 28, with the spaced endless belts being interconnected by the step axles 24, to which the steps 18 are connected. Each belt is supported by guide and support rollers or wheels 30 on the ends of the step axles 24, which cooperate with guide tracks 32. The steps 18 additionally include trail wheels or rollers 34 which cooperate with trailer guide tracks 36, which also aid in supporting the steps 18, and which also direct each step between the step and platform modes at the proper locations in the travel path. The conveyor unit 12 and attached steps 18 are driven by the drive unit 26 which engages the toothed links 28. The drive unit 26 is linked to handrail drive units disposed on each side of the conveyor unit 12, such as via a suitable handrail drive pulley disposed to drive a handrail drive unit.

A statonary skirt 37, commonly referred to as a skirt board, is disposed above the conveyor unit 12, on each side thereof, with the two skirt boards 37 being disposed immediately adjacent to the lateral edges or sides of the steps 18. A balustrade 38 extends upwardly from each of the two spaced skirt boards 37, for guiding a continuous flexible handrail 40 on each side of the conveyor 12. The balustrade 38 may be formed of transparent panels 42, as indicated in FIG. 1, or opaque panels, as desired.

Figure 3:
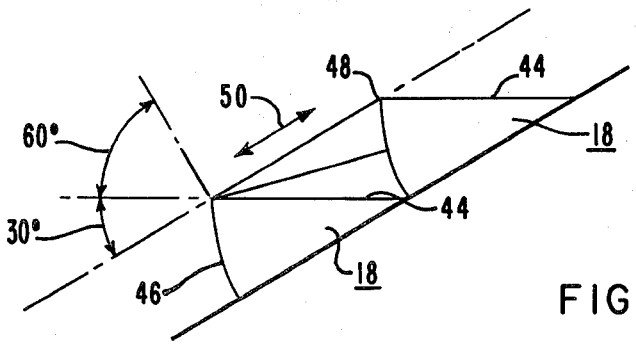
FIG. 3 is a diagrammatic view, in side elevation, of the steps of the escalator shown in FIG. 1, indicating the normal incident angles of relative motion between the tread and riser parts of the steps, and the stationary skirt boards at the side of a step.

Referring now to FIG. 3, which is a diagrammatic view of the steps 18, each step 18 includes a horizontally oriented tread part 44, and a riser part 46. The riser part 46 curves downwardly from the front or nose 48 of each tread part 44, and it makes about a 60° angle adjacent to the tread part of the next lower step. Thus, with the conventional escalator which is moving along a 30° angle on the inclined portion of the load bearing run 14, indicated by arrow 50, the incident angle of relative motion between tread part and the adjacent stationary skirt board 37 is 30°. The incident angle of relative motion between the riser part 46 and the adjacent stationary skirt board 37 is about 60°.

The present invention, stated in its broadest terms, includes means on the conveyor unit 12 which provides a substantially zero incident angle of relative motion between the moving conveyor unit 12, which includes the steps 18, and the stationary skirt boards 37. In other words, the conveyor unit 12 is modified such that the motion interface between the moving conveyor unit 12 and the stationary skirt boards 37 creates no relative motion which tends to trap or push an object between the conveyor unit 12 and the skirt boards 37. In a preferred embodiment of the invention, the means which is used to implement the invention, also cooperates with the skirt boards to provide lateral guidance for the conveyor 12, at least through the load bearing run.

More specifically, the present invention modifies each step 18 by adding panel means 52 to each side thereof, with the panel means 52 being automatically operable between first and second positions by the movement or articulation of the steps 18 between step mode on the incline, and platform mode adjacent to each landing. The panel means 52 transfers the motion interface upwardly and away from the normal motion interfaces between the tread part 44 and skirt boards 37, and between the riser part 46 and skirt boards 37. The new motion interface between the panel means 52 and skirt boards 37 includes a surface 54, i.e., the uppermost edge, on the panel means 52, which is oriented substantially parallel with the direction of movement of the conveyor unit 12. Thus, the incident angle of relative motion between edge 54 of panel means 52 and the skirt boards 37 is substantially zero at all locations of the load bearing run.

The panel means 52 extends from the step nose 48 on one step 18 to the step nose 48 of the next higher step 18. When the steps 18 are in step mode on the inclined portion of the load bearing run, the panel means 52 is operated to its first position in which it completely covers a portion of the skirt board 37 adjacent to each step 18 which is located below a line drawn between the step noses 48. As the steps 18 collapse to platform mode to enter a combplate at a landing, the step movement retracts the panel means 52 such that edge 54 is parallel with the tread surface of the tread part 44, and substantially at the same elevation as the tread surface, to enable the panel means 52 to pass through the combplate, such as through combplate 56 shown at the lower landing 22 in FIG. 1.

Depending upon the specific construction of escalator 10, the panel means 52 may include a single panel member at each lateral edge or side of a step 18, or the panel means 52 may include two, or more, panel members disposed to cooperatively function as a wall or barrier between an object on the tread part 44 and the immediately adjacent portion of the skirt board 37. In the exemplary embodiment of the invention, using the modular construction disclosed in the hereinbefore mentioned U.S. Pat. No. 3,677,388, it is necessary to construct the panel means 52 of at least first and second panel or plate members 58 and 60, respectively, in order to prevent interference between the panel means 52 and the step axles 24 when the panel means 52 is in its second or retracted position. The first and second panel members 58 and 60 are pivotally mounted to each step 18, such that they are immediately adjacent to one side of the step, with the pivot point being closely adjacent to the nose 48. The first and second panel members 58 and 60 unfold or fan apart when the steps articulate to step mode, to cooperatively define the wall or barrier along a side of the step. When the steps move to platform mode, the first and second panel members 58 and 60 fold or fan together for passage through the combplate 56. In a preferred embodiment of the invention, the first panel member 58 is the primary panel member because it is directly operated by step movement. The second panel member 60 is a secondary panel member, because it is operated by movement of the first or primary panel member 58.

More specifically, FIGS. 4 and 5 are elevational and plan views, respectively, of an exemplary embodiment of a first or primary panel member 58, and FIG. 6 is a fragmentary view of panel member 58, taken between and in the direction of arrows VI—VI in FIG. 4. FIGS. 4, 5 and 6 illustrate a right-hand version of the primary panel member 58, with reference to standing at the lower landing 22 and looking upwardly towards the upper landing.

The primary panel member 58 is constructed of a suitable material, which is the preferred embodiment is preferably a plastic material having a low coefficient of friction. For example, a polyurethane material is excellent because of its durability. The desired low coefficient of friction may be achieved by using a suitable filler in the polyurethane, such as a graphite filler or a silicone filler. Other suitable materials which may be used for the panel members are the polycarbonates, and tetrafluoroethylene, commonly known by the trademark Teflon.

Panel members 58, which may be molded to shape, for example, is a relatively thin, plate-like structure having first and second major sides or surfaces 62 and 64, respectively. Side 62, which is closely adjacent to skirt board 37, is flat and smooth, and side 64 includes a plurality of projections.

Panel member 58 has a substantially wedge-shaped configuration, when viewed in side elevation, having a relatively wide first end 65 which tapers inwardly to a relatively narrow second end 67, with the uppermost edge of the taper between ends 65 and 67 being the uppermost edge 54 of the panel means 52, which was hereinbefore referred to. Edge 54 may be chamfered at 55, to discourage using it as a shelf to support objects. The bottom edge 69 of the taper includes an indentation 71 and a stepped portion 73, which will be hereinafter explained. A curved indentation 75 is provided in the first end 65, adjacent to the upper edge 54, and the second end 67 has the configuration of a partial circle. The partial circle configuration cooperates with the curved portion 75 of the next adjacent primary panel member 58, as will be hereinafter explained.

A metallic pivot pin 66 has one end embedded in plate member 58, and it extends perpendicularly outward from side 64. A first projection 68, circular is configuration, surrounds the pin 66, extending outwardly from side 64, concentric with the longitudinal axis 70 of pin 66. Second and third projections 72 and 74 on side 64 operate the second or secondary panel member 60, when the first or primary panel member 58 is actuated by the steps 18.

Side 64 may include a plurality of spaced, curved rib portions 79, concentric about axis 70, to support and guide the secondary panel member 60 as the primary and secondary panel members fan apart and fold together. A step portion 73 is shown in more detail in FIG. 6, which is a view taken between and in the direction of arrows VI—VI in FIG. 4. The step portion 73 curves outwardly away from side 64, and it terminates in a leg portion 76 which is spaced from and parallel to the major, thin portion of the primary panel member 58. Step portion 73 is used in an exemplary arrangement for holding the panel members in the desired position during each turnaround, as will be hereinafter explained.

Figure 8:
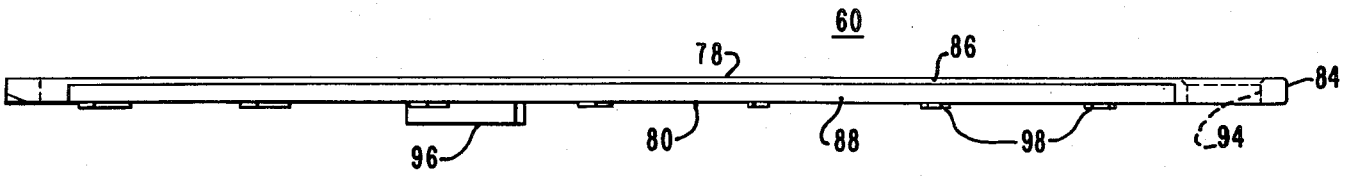
FIG. 8 is a plan view of the secondary panel member shown in FIG. 7.
Figure 7:
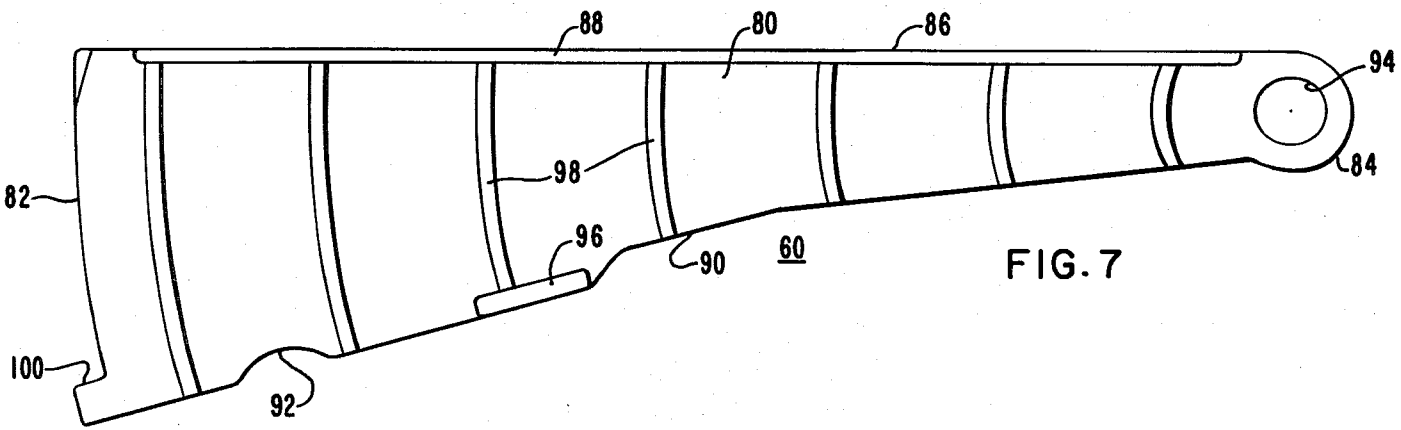
FIG. 7 is a side elevational view of a secondary panel or plate member for one side of an escalator step, constructed according to an exemplary embodiment of the invention.

FIGS. 7 and 8 are side elevational and plan views, respectively, of the second or secondary plate member 60. Member 60 is a right-hand version, which cooperates with the right-hand version of the primary panel member 58 shown in FIGS. 4 and 5. Panel member 60, which may be formed of the same material as panel member 58, is a relatively thin, plate-like structure having first and second major sides or surfaces 78 and 80, respectively. Side 78, which is in contact with the ribs 79 on panel member 58, is flat and smooth, while side 80 includes a plurality of projections which will be hereinafter described.

Panel member 60 has a substantially wedge-shaped configuration, when viewed in side elevation, having a relatively wide first end 82 which tapers inwardly to a relatively narrow second end 84. The uppermost edge 86 of the taper may be chamfered at 88, for the same reasons as chamfer 55 on the primary panel member 58. The bottom edge 90 of the taper may have a slight indentation 92, for purposes which will hereinafter become apparent.

An opening 94 is provided near end 84, which extends between the first and second major sides 78 and 80, with the diameter of opening 94 being sized to snugly but rotatably fit the projection or boss 68 on the primary panel member 58. A projection 96 is provided on side 80, near the lower edge 90, to provide a stop which will engage the underside of the tread part 44, to prevent the second panel member 60 from being pulled too high, in the event of friction between the primary and secondary panel members. A plurality of spaced, curved ribs 98, concentric with the axis of opening 94, provide wear strips for the relative movement between the panel member 60 and the side surface of the step 18 adjacent to which it is to be mounted. An outward step 100, for cooperation with projections 74 on the primary member 58, completes the secondary panel member 60.

Figure 9:
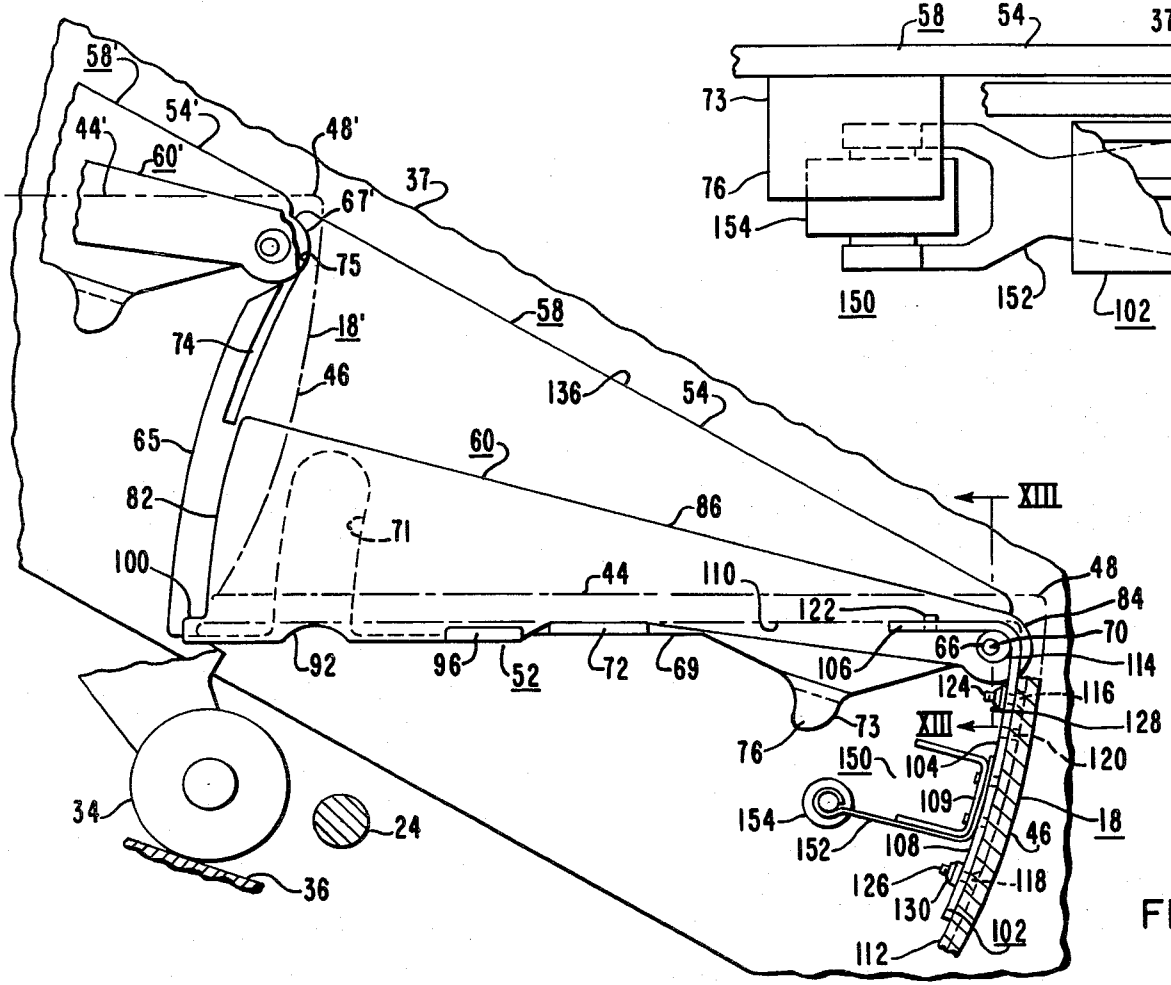
FIG. 9 is a fragmentary view, in side elevation, of escalator steps in step mode, illustrating the panel members of the invention on the inclined portion of the load bearing run.

FIG. 9 is a side elevational view of the steps 18, shown partially in phantom. The steps 18 are shown in step mode on the inclined portion of the load bearing run 14, and thus the panel means 52 on the associated steps are in their extended or first operating configuration.

Figure 10:
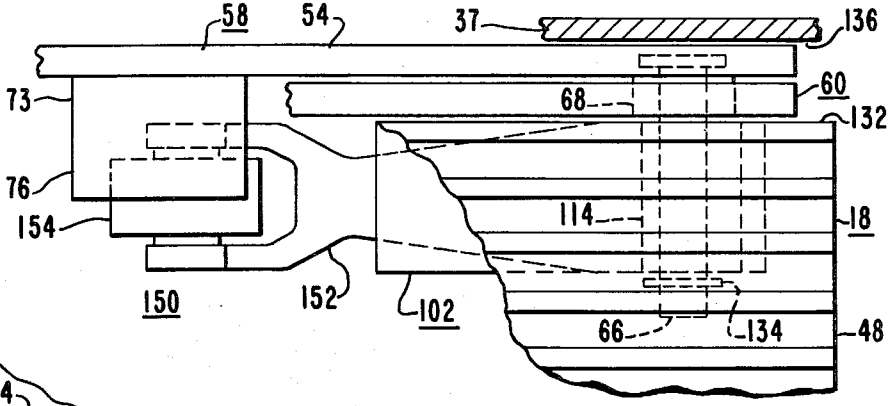
FIG. 10 is a fragmentary plan view of the panel member shown in FIG. 9, with the plan view being adjacent to the common pivot axis of the panel members.

The primary and secondary panel members 58 and 60, respectively, of each panel means 52 are mounted adjacent to one side of each step 18, via mounting means 102. FIG. 10 is a plan view of mounting means 102. Mounting means 102 includes a metallic mounting bracket 104 having first and second leg members 106 and 108, respectively, disposed at a predetermined angle relative to one another. Leg member 106 is straight, for cooperation with the flat underside portion 110 of tread part 44, while leg member 108 is curved to conform to the curved inside portion 112 of the riser part 46. A metallic dowel member 114 is fixed to the mounting bracket 104, at the juncture between the first and second leg members 106 and 108, such as by welding, and the dowel member 114 is drilled to receive and to allow pivotal movement of pin member 66.

The step riser part 46 is drilled in the riser grooves at 116 and 118, and it is also provided with a locating pin 120 on its inner surface 112. Leg member 108 is provided with openings which are located for alignment with pin 120 and the openings 116 and 118. The step tread part 44 is provided with a locating pin 122 on its inner surface 110, and leg member 106 includes an opening for receiving pin 122.

Mounting means 102 is mounted to the step 18 by placing its leg members 106 and 108 in position on the locating pins 120 and 122. Screws 124 and 126 are then inserted into the openings 116 and 118, respectively, and through the aligned openings in leg member 108. Nut members 128 and 130 are then coupled with the screws 124 and 126, respectively, to firmly secure the mounting means 102 to the step 18.

The primary and secondary panel members 58 and 60 are then assembled, with the circular projection 68 on the primary panel member 58 entering the opening 94 in the secondary panel member 60. The assembled panel members are then placed adjacent to side 132 of step 18, as shown in FIG. 10, and the pin 66 is advanced into the drilled opening in member 114. A clip 134 is snapped into a groove located near the end of pin 66, to secure pin 66 in the illustrated assembled position. The primary and secondary panel members 58 and 60 are thus pivotable about pivot axis 70.

On the inclined portion of the load bearing run, the curved end 67' of the primary panel 58' on the next higher step 18', as shown in FIG. 6, engages the curved opening 75 in the first end 65 of the primary panel member 58 on step 18. The primary panel member 58 is thus held in its first or elevated position, and the secondary panel member 60 is held in its first or elevated position by the projection 72 on the primary panel member 58. When the secondary panel member 60 is resting on projection 72, it will be noted that projection 96 on the secondary panel member is located just below the underside surface 110 of the tread part 44. Should the secondary panel member 60 be lifted into position by friction between the panel members, rather than by projection 72, projection 96 will contact side 110 and stop the upward travel of the secondary panel member 60. It will also be noted that the secondary panel member 60 completely covers the indentation 71 in the primary member 58, and that the two panel members are unfolded or fanned apart to cooperatively provide a solid wall portion which extends from step nose 48' to step nose 48. Thus, an object on tread part 44 is completely shielded from the stationary skirt board 37. In addition to providing this wall or shielding function, edge 54 of the panel means 52 is oriented in the direction of motion of the conveyor 12. Thus, the interface 136 between the moving and stationary elements of the escalator produces no forces which tend to trap or push objects into the narrow gap. An object deliberately placed at the motion interface and pushed against the stationary skirt board 37 will be dragged parallel with the edge 54.

Figure 11:
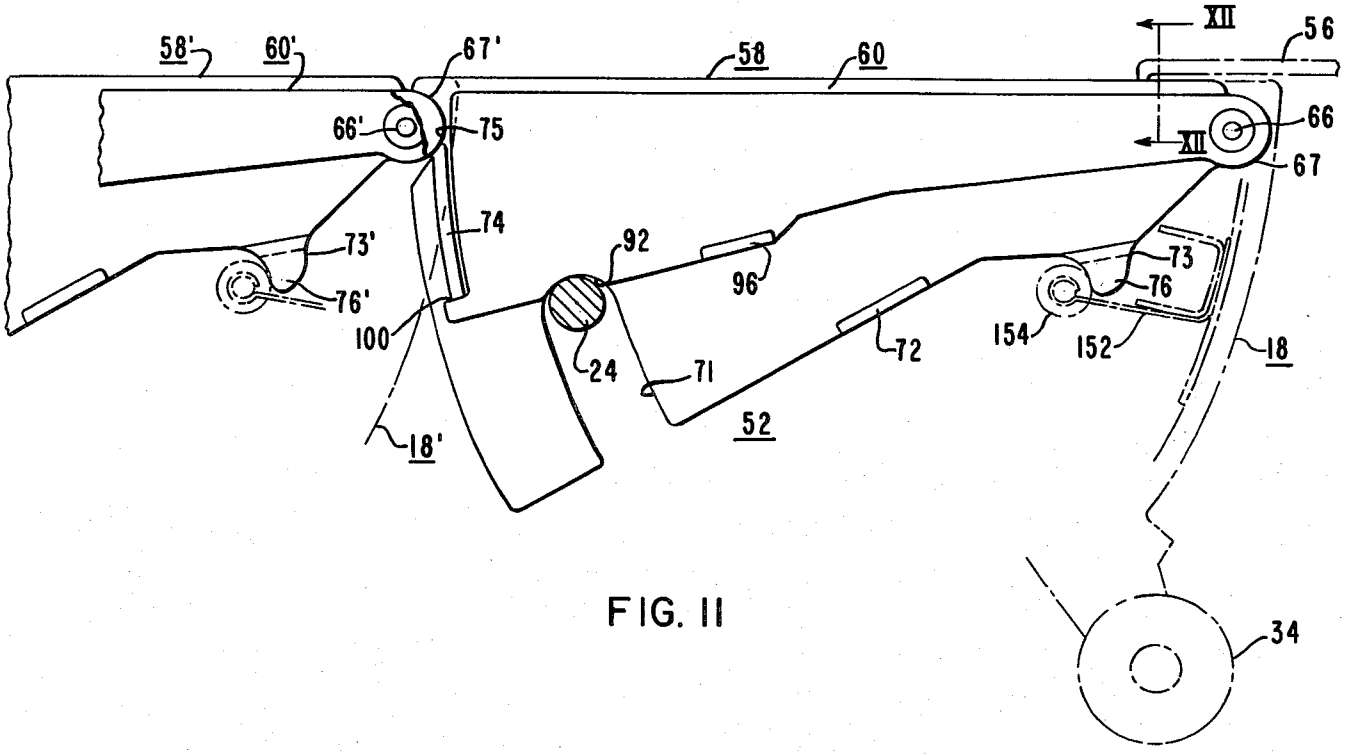
FIG. 11 is a fragmentary view, in side elevation, of escalator steps in platform mode, illustrating the panel members of the invention on a horizontal landing portion of the load bearing run, adjacent to a combplate.

When the steps 18 move from step mode to platform mode, as the steps approach a combplate 56, the panel means 52 automatically retracts due to step movement or articulation. FIG. 11 illustrates the steps 18 in platform mode and the panel means 52 in their retracted or second position. Should the secondary panel member 60 be held up by friction as the primary panel member 58 starts to pivot downwardly, projection 74 on the primary panel member 58 will contact step 100 on the secondary panel member 60 and pivot the secondary panel member 60 to its retracted position. It will be clear from FIG. 11 why two panel members are used instead of one, when the location of the step axle 24 is in the illustrated position. The indentation 71 of the primary panel member 58 receives the step axle 24, and the top portion of the indentation rests upon the step axle 24. Also, the slight indentation 92 in the secondary panel member 60 rests upon the step axle 24.

Figure 12:
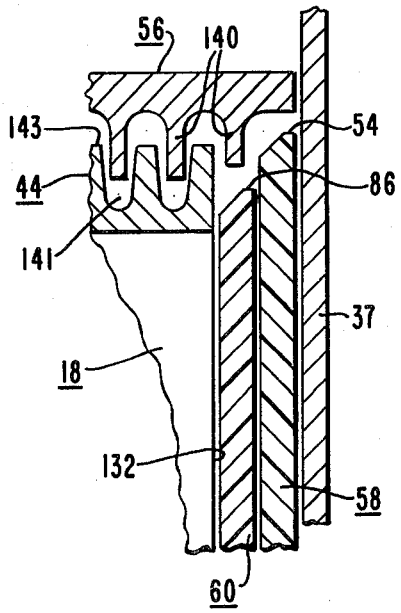
FIG. 12 is a cross-sectional view taken through the combplate in FIG. 11, between and in the direction of arrows XII—XII.

When the panel members 58 and 60 are fully retracted, their upper edges are parallel with the upper surface of the step tread part 44. As illustrated in FIG. 12, which is a cross-sectional view of the panel members 58 and 60 shown as they enter combplate 56, which view is taken between and in the direction of arrows XII—XII in FIG. 11, the upper edges 54 and 86 of the primary and secondary panel members 58 and 60, respectively, may be vertically offset from one another for providing a combing action with the teeth 140 of the combplate 56, similar to the combing action of the teeth 140 as they enter the grooves 141 between upstanding cleats 143 of the tread part 44.

When it is desired to remove a step 18 on the inclined portion of the load bearing run, it is only necessary to remove the panel means 52 associated with one of the steps. Additional steps may then be removed without disassembling the panel means 52 from these additional steps. The countersunk access holes or openings 116 and 118 in the riser part allow quick disassembly of the panel means 52 on the initial step to be removed.

When the steps 18 go into the turnaround 142 at the lower landing 22, if traveling downwardly, (see FIG. 2), or into the turnaround 144 at the upper landing 20, if the steps are traveling upwardly, the steps 18 separate, and thus the complementary nesting portions of the primary panel members disengage. They must properly reengage as the steps 18 come out of a turnaround and enter the load bearing run. It would also be desirable to prevent the panel members 58 and 60 from pivoting downwardly during the return run, as they may strike support or guide track portions of the escalator 10. Thus, the complementary portions may also be reengaged during the return run to maintain them in a controlled position.

The means for insuring correct reengagement of the primary panel members 58 as the steps 18 come out of a turnaround may take any one of several forms. A preferred embodiment of suitable bias means 150 is shown in FIGS. 9, 10 and 11. The bias means, for example, may include a leaf spring 152 and a roller 154. The leaf spring 152 and roller 154 are assembled, and the leaf spring 152 is attached to leg member 108 of the mounting bracket 104 via a suitable mounting bracket 109. The roller 154, which is rotatably mounted on one end of the leaf spring 152, extends outwardly from the inner surface 112 of the riser part 46. The roller is positioned such that it will slightly interfere with the leg 76 of projection 73 on the primary panel member 58, as the primary panel member approaches its second or fully retracted position. Thus, the leaf spring 152 is flexed slightly and the roller 154 rolls about the end of leg 76 and snaps back to the position shown in FIG. 11 to hold the primary and secondary panel members in this position throughout the turnaround. When the primary panel members 58 reengage following the turnaround, and the steps rise to step mode, the leaf spring 152 is again flexed by the upward motion of the primary panel member 58, to disengage roller 154 from the stepped projection 73. A leaf spring 152 is illustrated in the Figures, and it is preferred because it provides latching forces on the panel members only when they are actually required, i.e., when the panel members are in their second or fully retracted positions. Another embodiment includes eliminating the stepped projection 73 and providing a projection on the primary panel member for receiving one end of a coiled tension spring. The other end of the tension spring would be attached to the mounting bracket 104. A tension spring, however, would apply a continuous force to the panel members, and it would not have as long a useful operating life as the leaf spring.

An alternative to the use of springs, or an addition to a spring embodiment, as desired, is shown in FIGS. 2A and 2B. In this embodiment, a pair of cam members are provided at the lower turnaround 142, one on each side of the steps 18, such as cam member 160, and a pair of cam members are provided at the upper turnaround 144, such as cam member 162. The cam members 160 and 162 are configured and located to limit the outward travel of the panel members 58 and 60 during the turnaround, and to guide them into the proper position for reengagement with one another following a turnaround.

It is important to guide the steps 18 laterally as they proceed through the load bearing run, combplates, and return run. As shown in U.S. Pat. No. 3,682,289, which is assigned to the same assignee as the present application, guide rollers may be rotatably mounted on each step link 28, which coact with a guide element on the skirt board 37. U.S. Pat. Nos. 4,064,986 and 4,249,649, which are also assigned to the same assignee as the present application, illustrate guide wheels/guide track configurations for providing such lateral guidance. In the preferred embodiment of the present invention, the panel means 52 cooperates with the skirt boards 37 to provide lateral step guidance, at least through the load bearing run of the escalator 10. In addition to substantially reducing the cost of the guidance system, this arrangement has the advantage of reducing the running clearance between the primary panel and skirt board.

Figure 13:
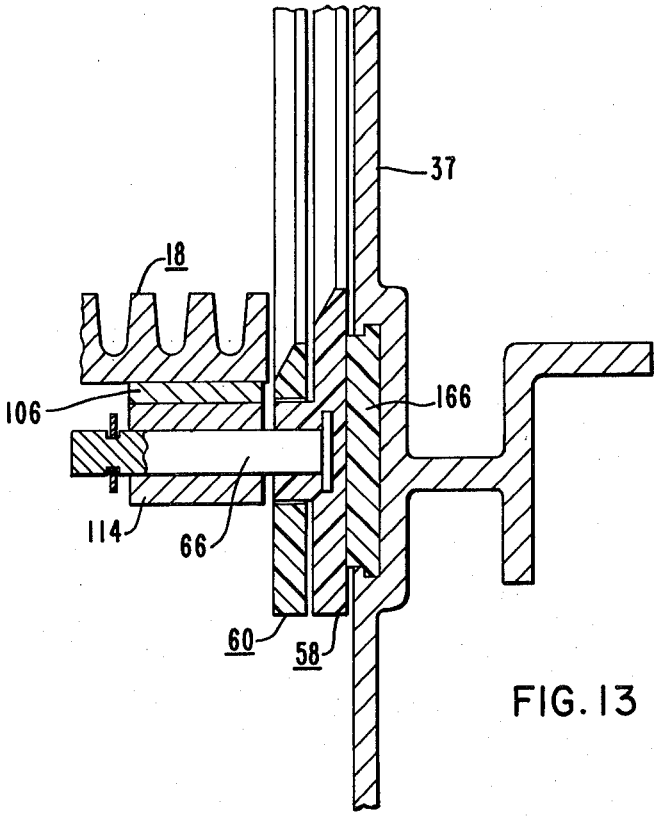
FIG. 13 is a cross-sectional view taken between and in the direction of arrows XIII—XIII in FIG. 9, illustrating a step guide arrangement constructed according to the teachings of the invention.

FIG. 13, which is a cross-sectional view of the panel means 52 and adjacent skirt board 37, taken between and in the direction of arrows XIII—XIII in FIG. 9, sets forth an exemplary embodiment of the use of the panel means 52 in the lateral guiding of the steps 18.

More specifically, as shown in FIG. 13, the skirt board 37, on each side of the steps 18, is provided with an insert member 166 formed of a plastic material having a low coefficient of friction, such as the same material of which the panel members 58 and 60 are constructed. This insert member 166 may be in the form of a continuous strip along the load bearing run, and it is preferably located adjacent to the portion of the primary panel member 58 where the pin 66 is embedded. The lateral forces of the steps 18 are very small, in the order of a few pounds, and thus wear of the panel member 58 and insert member 166 will be slight. In operation the two skirt boards 37 are adjusted such that their insert members 166 just contact the primary panel member 58. Thus, the spacing between the primary panel member 58 and skirt board 37 at the motion interface can be adjusted to provide a smaller running clearance than is normally provided.

The panel means 52 may also be used to provide lateral guidance on the return run; or, one of the guide wheel/guide track arrangements of the hereinbefore mentioned U.S. patents may be used to provide lateral guidance on the return run. If the panels are not used for guidance on the return run, the panel members 58 and 60 may be maintained in a vertical orientation during the return run by suitable washer members (not shown) on the step axles.

In summary, there has been disclosed a new and improved escalator in which side panel members are provided on each step, which members eliminate relative motion between an object resting on a moving step and the adjacent stationary skirt boards. In addition to providing step shields, the side panel members are constructed such that the incident angle of relative motion between the panel members and skirt boards at the motion interface is substantially zero. Still further, the side panel members automatically maintain this substantially zero incident angle of relative motion throughout the load bearing run, as the side panels automatically move with step articulation between the fully extended position on the inclined portion of the run, and a fully retracted position at each combplate. In addition to maintaining the substantially zero incident angle of relative motion, the retracted position enables the panel members to move through the combplate without modification of the combplates, and with a combing action, as illustrated in FIG. 12. Since the skirt boards 37 are shielded from the steps 18, the four skirt switches normally provided in prior art escalators to detect an object trapped between a step and a skirt adjacent to each combplate, are unnecessary. They may be replaced by two switches, one on each side of the escalator, disposed to detect a missing side panel member.

I claim as my invention:

1. A moving stairway extending between upper and lower landings, comprising:

a support structure, a conveyor mounted on said support structure, said conveyor including a plurality of step axles, drive means for driving said conveyor in a loop which includes an upper load bearing run, skirt means mounted on said support structure to define at least one stationary wall portion adjacent to said load bearing run, a plurality of steps having tread portions, said steps being attached to the step axles of said conveyor for articulation between a step mode on said load bearing run and a platform mode adjacent to each landing, and panel means movably attached to each of said steps such that articulation of said steps to step mode moves said panel means to a first position in which the panel means defines a side wall portion on each step adjacent to said at least one stationary wall portion, and articulation of said steps to platform mode moves said panel means to a second position, each of said panel means including first and second pivotally related panel members arranged to fan apart and cooperatively define the sidewall portion when the panel means is in its first position, said second position of the panel means being a retracted position wherein the first and second panel members fold together to substantially the level of the associated tread portion, at least the first panel member defining an indented portion configured to permit retraction without interference with a step axle, said second panel member being configured to cover the indented portion of the associated first panel member when the panel means is in the first position.

2. The moving stairway of claim 1 wherein the first panel member at each side of each step is removably engaged with the first panel member on a next adjacent step, such that movement of the steps between modes automatically pivots the panel members to continuously adjust a predetermined edge of the first panel member to be substantially parallel with the direction of motion.

3. The moving stairway of claim 1 wherein the first and second panel members are pivotally attached to each step adjacent each lateral edge thereof, with the first panel member having an edge which provides a relative motion interface between the moving conveyor and the stationary skirt means, with said edge being continuously substantially parallel with the direction of motion of the conveyor during the load bearing run.

4. The moving stairway of claim 1, wherein at least one of the first and second panel members at each lateral step edge is removably engaged with a panel member of an adjacent step, such the movement of the steps from platform to step mode fans the first and second panel members apart to provide a composite wall which extends along the lateral edges of each step, to eliminate a relative motion interface between the steps and skirt means, and with the movement of the steps from step to platform mode folding the first and second panel members together.

5. The moving stairway of claim 1 wherein each of the steps includes a riser part which intersects a tread portion to define a nose portion at their intersection, and wherein the first panel member, in its first position, extends substantially from the nose portion of one step to the nose portion of the next adjacent step.

6. The moving stairway of claim 1 wherein the loop includes a return run, with the upper and lower turnarounds interconnecting the load bearing and return runs, and wherein each of the first panel members includes first and second complementary portions, with the first complementary portion of the first panel member engaging the second complementary portion of an adjacent first panel member on the load bearing run, and disengaging during the upper and lower turnarounds.

7. The moving stairway of claim 6 including means disposed to maintain the panel members in predetermined positions during each turnaround selected to insure proper reengagement of the first and second complementary portions of the first panel members following a turnaround.

8. The moving stairway of claim 6 including cam means disposed adjacent to each turnaround located to guide each first panel member into reengagement with an adjacent panel first members following each turnaround.

9. The moving stairway of claim 1 including a combplate disposed adjacent to each landing, with the second position of said first and second panel members being a position selected to enable the panel members to pass through each combplate without interference.

10. The moving stairway of claim 9 wherein the tread portion of each step includes spaced upstanding cleats and intervening grooves, and each combplate includes a plurality of spaced depending teeth which mesh with the cleats of each step during relative motion therebetween, and wherein the retracted position of the first and second panel members is selected to cause the panel members to function as cleats which cooperate with the combplate teeth to provide a combing action therebetween.

11. The moving stairway of claim 1 wherein the first and second skirt members define first and second stationary wall portions, respectively, on opposite sides of the load bearing run, the first and second panel members define first and second sidewall portions on each step adjacent to said first and second stationary wall portions, respectively, and wherein the first and second stationary sidewall portions are respectively positioned relative to the first and second sidewall portions on the steps, to laterally guide the steps and conveyor on the load bearing run.

12. The moving stairway of claim 11 wherein at least the first panel member is non-metallic and the first and second sidewall portions each include non-metallic guide means positioned to laterally guide the steps and conveyor via contact with said non-metallic first panel member.

13. The moving stairway of claim 1 wherein each of the steps includes a side portion disposed adjacent to and in predetermined spaced relationship with the at least one stationary wall portion, and the first and second panel members of the panel means are pivotally affixed adjacent to said side portion, in the predetermined space between said side portion and the stationary wall portion.

14. The moving stairway of claim 13 wherein each step includes a riser part which intersects a tread portion to define a nose portion at their intersection, and wherein the first and second panel members fan apart when the steps move to step mode, to provide a composite wall portion which extends between nose portions of adjacent steps.

15. The moving stairway of claim 1 wherein the first and second panel members are pivotally fixed to each step on a common pivot axis, with each panel member having predetermined first and second positions when the panel means is in the extended and retracted positions, respectively, the first panel member of each step being aligned with the first panel member of an adjacent step, and cooperatively configured such that they are in engagement, at least on the load bearing run, and operated between their extended and retracted positions on the load bearing run in response to relative movement between adjacent steps.

16. The moving stairway of claim 15 wherein the first panel member includes positioning means for forcing the second panel member to pivot to its first and second locations as the first panel is moved to its first and second positions, respectively, in response to relative step movement.

17. The moving stairway of claim 16 wherein the positioning means includes a first projection on the first panel member disposed to lift the second panel member when the first panel member is pivoted to its first position, and a second projection on the first panel member disposed to push the second panel member downwardly as the first panel member is pivoted to its second position.

18. The moving stairway of claim 15 wherein the loop in which the conveyor unit is driven includes a return run and upper and lower turnarounds between the load bearing and return runs, and with the first and second panel members being in their second positions during the turnarounds, and including bias means on each step disposed to bias the first and second panel members toward their second positions, at least while they are in their second positions.

19. The moving stairway of claim 18 wherein the first panel member includes a projecting portion which cooperates with the bias means, and wherein the bias means includes means for engaging said projecting portion when the first panel member is moved to its second position, and spring means for resiliently mounting said means which engages the projecting portion.

20. The moving stairway of claim 1 wherein the side wall portion defined by the panel means includes an upper edge adjacent to the stationary wall portion defined by the skirt means, with said upper edge being aligned with the stairway travel direction on the load bearing run.

21. The moving stairway of claim 1 wherein the first panel member on each side of each step nests with a first panel member of an adjacent step during the load bearing run, with said nesting causing the first and second panel members to move between the extended and retracted positions in response to articulation of the steps between step and platform modes.

22. A moving stairway extending between upper and lower landings, comprising:

a support structure, an endless, flexible conveyor unit mounted on said support structure, with said conveyor unit including spaced step axles, drive means for driving said conveyor unit in a loop which includes an upper load bearing run and a lower return run, first and second skirt members mounted in spaced relation on said support structure, on opposite sides of said conveyor unit, to respectively define first and second substantially vertical stationary sidewall portions adjacent to the load bearing run, a plurality of steps mounted on said step axles for articulation between a step mode on the load bearing run and a platform mode adjacent each landing, each of said steps having first and second side portions disposed adjacent to and in predetermined spaced relation with said first and second skirt members, respectively, and panel means including first and second panel members pivotally attached to each side of each of said steps, in the predetermined space between the side portions and adjacent skirt members, with movement of said steps to step mode fanning the first and second panel members apart, to an extended position in which they define a substantially vertical composite sidewall portion on each step, and with movement of said steps to platform mode folding said first and second panel members to a retracted position, said first panel member having a predetermined edge which provides a relative motion interface between the moving conveyor unit and the adjacent stationary skirt member, with said edge being continuously substantially parallel with the direction of motion of the conveyor unit during the load bearing run, at least the first panel member defining an indented portion configured to permit folding of the first and second panel members without interference with a step axle, and wherein the second panel member is configured to cover the indented portion of the associated first panel member when the first and second panel members are in the extended position.

* * * * *